US005947694A

United States Patent [19]

Hablanian

[11] Patent Number: 5,947,694

[45] Date of Patent: Sep. 7, 1999

[54] SCROLL-TYPE VACUUM PUMPING APPARATUS

[75] Inventor: Marsbed Hablanian, Wellesley, Mass.

[73] Assignee: Varian, Inc., Palo Alto, Calif.

[21] Appl. No.: 09/138,850

[22] Filed: Aug. 24, 1998

Related U.S. Application Data

[63] Continuation-in-part of application No. 08/806,882, Feb. 25, 1997, abandoned.

[51] Int. Cl.[6] ..... F04B 23/14

[52] U.S. Cl. ..... 417/201; 417/205; 418/3; 418/5; 418/55.2

[58] Field of Search ..... 417/201, 205; 418/3, 5, 55.2

[56] References Cited

U.S. PATENT DOCUMENTS

| | | | |
|---|---|---|---|
| 1,376,291 | 4/1921 | Rolkerr | 418/6 |
| 5,417,554 | 5/1995 | Kietzman et al. | 418/55.2 |
| 5,616,015 | 4/1997 | Lieperrt | 418/5 |

OTHER PUBLICATIONS

M. Habalanian, "High Vacuum Technology", Marcel Decker, 1990.

*Primary Examiner*—Timothy S. Thorpe
*Assistant Examiner*—Ehud Gartenberg
*Attorney, Agent, or Firm*—Bella Fishman; William R. McClellan

[57] ABSTRACT

Vacuum pumping apparatus includes a non-scroll type auxiliary pump and a scroll pump disposed in a single housing. The auxiliary pump and the scroll pump are connected in series and are driven by a common motor. Typically, the auxiliary pump has a relatively high pumping speed and the scroll pump has a relatively high compression ratio. The auxiliary pump may be a regenerative blower, a roots-type blower or a screw-type blower. When a co-rotating scroll pump is utilized, a regenerative blower may be formed at or near the outer periphery of a disk on which the non-orbiting scroll blade is mounted. In another configuration, first and second scroll pumps are disposed within a housing. The scroll blade sets of the first and second scroll pumps have different orbiting radii. Scroll pump leakage may be reduced by forming a closed-loop seal around the inlet region of the scroll pump and connecting the inlet region to an intermediate pressure. Scroll pump leakage and contamination may be reduced in a scroll pump structure wherein the drive components and the orbiting scroll blade are located on opposite sides of the non-orbiting scroll blade.

4 Claims, 6 Drawing Sheets

SCROLL-TYPE VACUUM PUMPING APPARATUS

This application is a continuation-in-part of the U.S. application Ser. No. 8/806,882 filed Feb. 25, 1997 now abandoned.

BACKGROUND OF THE INVENTION

This invention relates to vacuum pumping apparatus which incorporate scroll-type pumps and, more particularly, to vacuum pumping apparatus which are characterized by high pumping speed and high compression ratio.

Scroll pumps are disclosed in U.S. Pat. No. 801,182 issued in 1905 to Creux. In a scroll pump, a movable spiral blade orbits with respect to a fixed spiral blade within a housing. The configuration of the scroll blades and their relative motion traps one or more volumes or "pockets" of a fluid between the blades and moves the fluid through the pump. The Creux patent describes using the energy of steam to drive the blades to produce rotary power output. Most applications, however, apply rotary power to pump a fluid through the device. Oil lubricated scroll pumps are widely used as refrigerant compressors. Other applications include expanders which operate in reverse from a compressor, and vacuum pumps. To date, scroll pumps have not been widely adopted for use as vacuum pumps.

Scroll pumps must satisfy a number of often conflicting design objectives. The scroll blades must be configured to interact with each other so that their relative motion defines the pockets that transport, and often compress, the fluid within the pockets. The blades must therefore move relative to each other, with seals formed between adjacent turns. In vacuum pumping, the vacuum level achievable by the pump is often limited by the tendency of high pressure gas at the outlet to flow backwards toward the lower pressure inlet and to leak through the sliding seals to the inlet. The effectiveness and durability of the scroll blade seals, both tip seals along the spiral edges of the scroll blades and clearance seals between fixed and movable scroll blades, are important determinants of performance and reliability.

In vacuum pumping applications, it is desirable to pump gas from the chamber being evacuated at high speed. Scroll pumps optimized for high pumping speed may not be well suited for operating across a large pressure differential, for example, between a few milliTorr the inlet and atmosphere (760 Torr) at the outlet. To support a large pressure differential, or compression ratio, it is known to use a scroll blade pair with multiple revolutions which have multiple clearance seals that block the backflow of the fluid from the high pressure at the outlet. However, the pumping speed of such a pump is limited.

An apparently straightforward solution to increasing pumping speed is to increase the maximum interblade spacing so that each pocket has a larger volume. For a constant scroll blade thickness, this spacing is defined by the orbiting radius. Therefore, pumping speed can, in theory, be increased by increasing the orbiting radius. However, a larger radius has various disadvantages, such as an increase in seal velocity and wear, an increase in the radial forces acting on the drive mechanism, and an increase in steady state power consumption. A larger orbiting radius also increases the overall dimensions of the pump. For a given pump diameter, a large orbiting radius results in fewer turns of the spiral configuration, fewer clearance seals in series and therefore, more back leakage. The apparently simple solution of increasing the orbiting radius therefore has the disadvantages of increased size, wear, power and frictional heating.

To increase pump capacity, it is also known to operate multiple scrolls in parallel, as is done by Iwata Air Compressor Corporation in its model ISP-600 dry scroll vacuum pump. A single stage roughing pump uses two parallel, back-to-back scroll blade sets that each have blades with an angular extent of more than four revolutions. While this pump has a nominal capacity of 20 cubic feet per minute (CFM), its pumping speed drops off significantly below 100 milliTorr, presumably due to back leakage through the pump from its outlet to its inlet. This is a significant problem in some applications which require pressures below 100 milliTorr. Another problem is that the pump can achieve a base pressure of only 5 milliTorr, whereas by comparison a commercial two-stage rotary, oil-lubricated roughing pump can produce base pressures of 0.5 milliTorr. Yet another problem is that this type of pump uses about 20 feet of tip seal material. Wear of this amount of tip seal produces significant debris which can contaminate the system being evacuated. This amount of sealing material also increases power requirements.

Another scroll pump design combines scroll pumps in series to achieve improved operating results. For example, U.S. Pat. No. 5,304,047 to Shibamoto discloses a two-stage, scroll-type, oil-lubricated refrigerator compressor. Shibamoto radially separates the inlet of the second stage from the outlet of the first stage. While Shibamoto discloses a two-stage pump, it is not suited for operation as a vacuum pump because it requires a dynamic, oil-lubricated seal at the outer edge of the orbiting second stage scroll to control back leakage of the gas. Also, oil is injected onto the moving parts in low and intermediate pressure zones, collected and recirculated.

Accordingly, it is desirable to provide vacuum pumping apparatus which incorporate scroll-type pumps and which achieve high pumping speed and high compression ratio, while avoiding the above-described disadvantages.

SUMMARY OF THE INVENTION

According to a first aspect of the invention, vacuum pumping apparatus comprises a housing, a non-scroll type auxiliary pump and a scroll pump, both disposed in the housing. The scroll pump comprises first and second nested scroll blades and an orbiting mechanism for producing orbiting movement of the first scroll blade relative to said second scroll blade. The apparatus further comprises conduit means for coupling fluid from the outlet of the auxiliary pump to the inlet of the scroll pump and a motor operationally connected to the auxiliary pump and to the scroll pump.

Preferably, the auxiliary pump has relatively high pumping speed, and the scroll pump has a relatively high compression ratio. The auxiliary pump may comprise a regenerative blower, a roots-type blower or a screw-type blower. The auxiliary pump and the scroll pump may be separate units within the housing or may be integrated together.

According to a second aspect of the invention, vacuum pumping apparatus comprises a housing having an inlet and an outlet, and first and second scroll pumps disposed in the housing. The first scroll pump has an inlet coupled to the housing inlet, and the second scroll pump has an outlet coupled to the housing outlet. The first scroll pump comprises first and second nested scroll blades and a first eccentric drive coupled to the first scroll blade for producing orbiting movement of the first scroll blade relative to the second scroll blade with a first orbiting radius. The second scroll pump comprises third and fourth nested scroll blades and a second eccentric drive coupled to the third scroll blade for producing orbiting movement of the third scroll blade relative to the fourth scroll blade with a second orbiting radius that is different from the first orbiting radius. The vacuum pump further comprises conduit means for coupling fluid from the outlet of the first scroll pump to the inlet of the second scroll pump and a motor operationally coupled to the first eccentric drive of the first scroll pump and to the second eccentric drive of the second scroll pump. The first orbiting radius is preferably larger than the second orbiting radius. In this embodiment, the first scroll pump has relatively high pumping speed, and the second scroll pump has a relatively high compression ratio, with the advantage of reducing size and power requirements.

According to a third aspect of the invention, vacuum pumping apparatus comprises a housing, a scroll pump disposed in the housing and a motor operationally connected to the scroll pump. The scroll pump comprises first and second nested scroll blades, and an orbiting mechanism coupled between the first and second scroll blades. The first and second scroll blades rotate during operation, and the orbiting mechanism produces orbiting movement of the first scroll blade relative to the second scroll blade. The vacuum pump further comprises a disk rigidly connected to the second scroll blade for rotation with the second scroll blade. The disk has a plurality of regenerative blower cavities at or near its outer periphery. The housing has a channel in opposed relationship to the regenerative blower cavities. The disk and the housing define a regenerative blower. The outlet of the regenerative blower is coupled to the inlet of the scroll pump. Preferably, the regenerative blower has a relatively high pumping speed, and the scroll pump has relatively high compression ratio.

According to a fourth aspect of the invention, vacuum pumping apparatus comprises a scroll blade set having an inlet and an outlet, and an eccentric drive. The scroll blade set comprises an orbiting member including a first scroll blade and a non-orbiting member including a second scroll blade. The first and second scroll blades are nested together to define one or more interblade pockets. The eccentric drive is operatively coupled to the orbiting member for producing orbiting movement of the first scroll blade relative to the second scroll blade so as to cause the interblade pockets to move toward the outlet. The vacuum pump further comprises a closed-loop sliding seal disposed between the orbiting member and the non-orbiting member and surrounding the first and second scroll blades to define an inlet volume coupled to the inlet of the scroll blade set, and a conduit connected to the inlet volume for pumping the inlet volume to an intermediate pressure that is lower than the pressure at the outlet of the scroll blade set.

According to a fifth aspect of the invention, vacuum pumping apparatus comprises a single scroll blade set having an inlet and an outlet, and an eccentric drive. The scroll blade set comprises an orbiting member including a first scroll blade and a non-orbiting member including a second scroll blade. The first and second scroll blades are nested together to define one or more interblade pockets. The eccentric drive is operatively coupled to the orbiting member for producing orbiting movement of the first scroll blade relative to the second scroll blade so as to cause the interblade pockets to move toward the outlet. The eccentric drive is coupled to the orbiting member through an opening in the non-orbiting member adjacent to the outlet. The eccentric drive and the first scroll blade are located on opposite sides of the second scroll blade, to reduce potential leakage into the pump inlet area from the environment of drive mechanisms.

BRIEF DESCRIPTION OF THE DRAWINGS

For better understanding of the present invention, reference is made to the accompanying drawings, which are incorporated herein by reference and in which.

DETAILED DESCRIPTION

Figure 1:
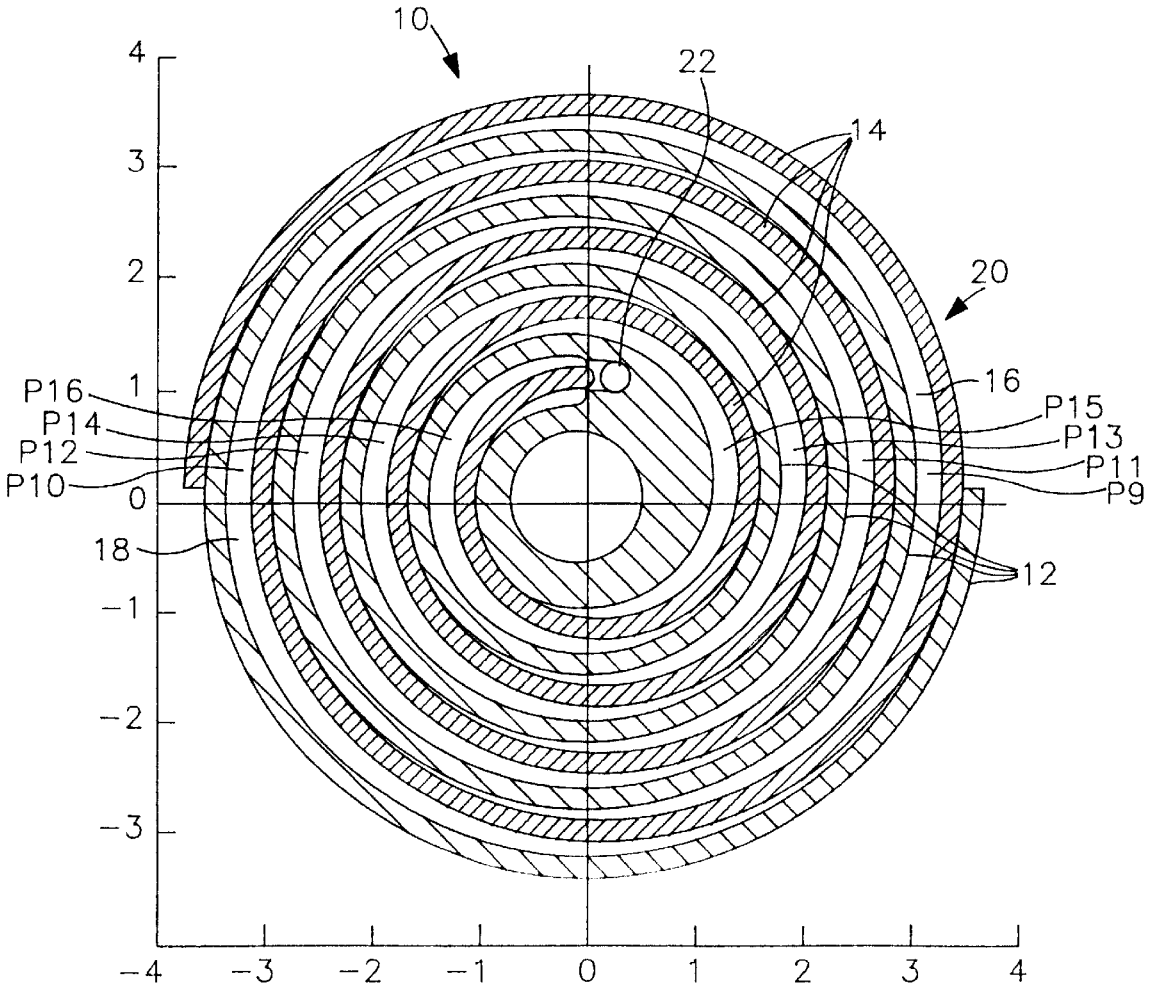
FIG. 1 is a schematic representation of an example of a set of scroll blades suitable for use in a scroll-type vacuum pump.

A scroll blade set suitable for use in a scroll pump is shown in FIG. 1. A scroll blade set 10 includes a fixed scroll blade 12 and a movable scroll blade 14. Each of the scroll blades has a spiral configuration. The scroll blades 12 and 14 are nested together and define interblade pockets, such as pockets 16 and 18. The movable scroll blade 14 is coupled to an eccentric drive (not shown in FIG. 1), such as a crank, to produce orbiting motion of movable scroll blade 14 relative to fixed scroll blade 12. An inlet region 20 extends in an annular band around the outer periphery of scroll blade set 10. An outlet 22 is located near the center of the scroll blade set 10.

A fluid, typically a gas, enters scroll blade set 10 at inlet region 20 and is enclosed in interblade pockets such as pockets 16 and 18. As the movable scroll blade 14 orbits relative to fixed scroll blade 12, the interblade pockets move from inlet region 20 toward outlet 22. Seals between scroll blades 12 and 14 limit leakage between adjacent spiral turns of the scroll blades. The volume of the interblade pockets typically decreases toward the center of the scroll set because of the reduced radius and circumference of the scroll blades, thereby compressing the gas being pumped. The pumping performance of the scroll pump depends on a number of parameters, including the number of turns of the scroll blades, the spacing between turns, the orbiting radius of scroll blade 14, the orbiting speed and leakage. The basic design of scroll pumps is generally known in the art and is described, for example, in U.S. Pat. No. 5,258,046 issued Nov. 2, 1993 to Haga et al.

Co-rotating scroll pumps are also known in the prior art. In a co-rotating scroll pump, both scroll blades rotate, and one scroll blade orbits relative to the other during rotation to provide pumping action. Co-rotating scroll pumps are described, for example, in U.S. Pat. No. 5,051,075 issued Sep. 24, 1991 to Young.

Figure 2:
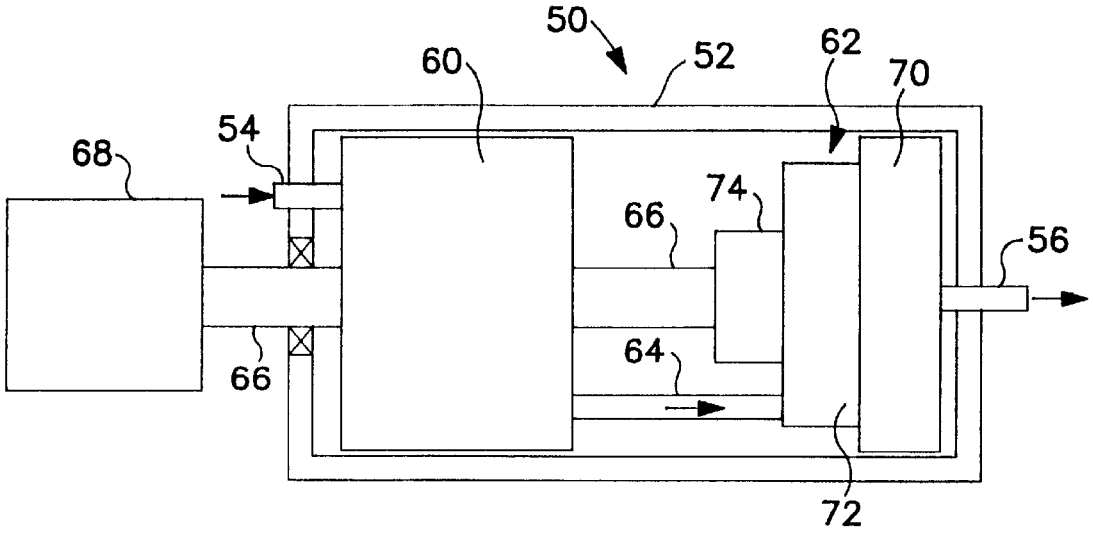
FIG. 2 is a schematic representation of vacuum pumping apparatus including an auxiliary pump and a scroll pump.

An example of vacuum pumping apparatus in accordance with a first aspect of the invention is shown in FIG. 2. The vacuum pumping apparatus includes a scroll pump and a non-scroll type auxiliary pump to provide desired vacuum pumping performance. Vacuum pumping apparatus 50 includes a vacuum-tight housing 52 having an inlet 54 and an outlet 56. A non-scroll type auxiliary pump 60 and a scroll pump 62 are disposed within housing 52. A drive shaft 66 couples auxiliary pump 60 and scroll pump 62 to a motor 68, typically located outside housing 52. Housing inlet 54 is coupled to an inlet of auxiliary pump 60, and housing outlet 56 is coupled to an outlet of scroll pump 62. A conduit 64 may interconnect an outlet of auxiliary pump 60 and an inlet of scroll pump 62, so that auxiliary pump 60 and scroll pump 62 are connected in series. In one approach, the auxiliary pump 60 and the scroll pump 62 may be separate units within housing 52, as shown in FIG. 2. In another approach, shown in FIG. 3 and described below, the auxiliary pump and the scroll pump may be integrated together within the housing. In yet another approach, the motor can be positioned between auxiliary pump 60 and scroll pump 62.

The non-scroll type auxiliary pump 60 may be characterized by relatively high pumping speed, or volumetric displacement rate. Suitable auxiliary pumps include regenerative blowers, roots-type blowers and screw-type blowers as described, for example, by M. Hablanian in *High Vacuum Technology*, Marcel Dekker 1990.

The scroll pump 62 includes a non-orbiting blade 70, an orbiting blade 72 and an eccentric drive 74. The eccentric drive 74 is connected between drive shaft 66 and orbiting scroll blade 72. When the motor 68 is energized, eccentric drive 74 produces orbiting movement of scroll blade 72 relative to scroll blade 70. The eccentric drive 74 may, for example, utilize a crank or any other eccentric drive mechanism. The design details of eccentric drives are well known to those skilled in the art. The scroll pump 62 may be a conventional type, wherein scroll blade 70 is fixed relative to housing 52, and scroll blade 72 orbits relative to scroll blade 70. Alternatively, the scroll pump 62 may be a co-rotating type, wherein scroll blade 70 and 72 both rotate, and eccentric drive 74 produces orbiting movement of scroll blade 72 relative to scroll blade 70. The scroll pump 62 may be characterized by a relatively high compression ratio.

The vacuum pumping apparatus 50, wherein auxiliary pump 60 has a relatively high pumping speed and scroll pump 62 has a relatively high compression ratio, produces desirable performance characteristics in a vacuum pump. Typically, high pumping speed is desired at the inlet of a vacuum pump and high compression ratio is desired at the outlet. The vacuum pumping apparatus 50, wherein auxiliary pump 60 and scroll pump 62 are mounted in the same housing 52 and are driven by the same motor 68, constitutes a hybrid vacuum pump having desired performance characteristics.

Figure 3:
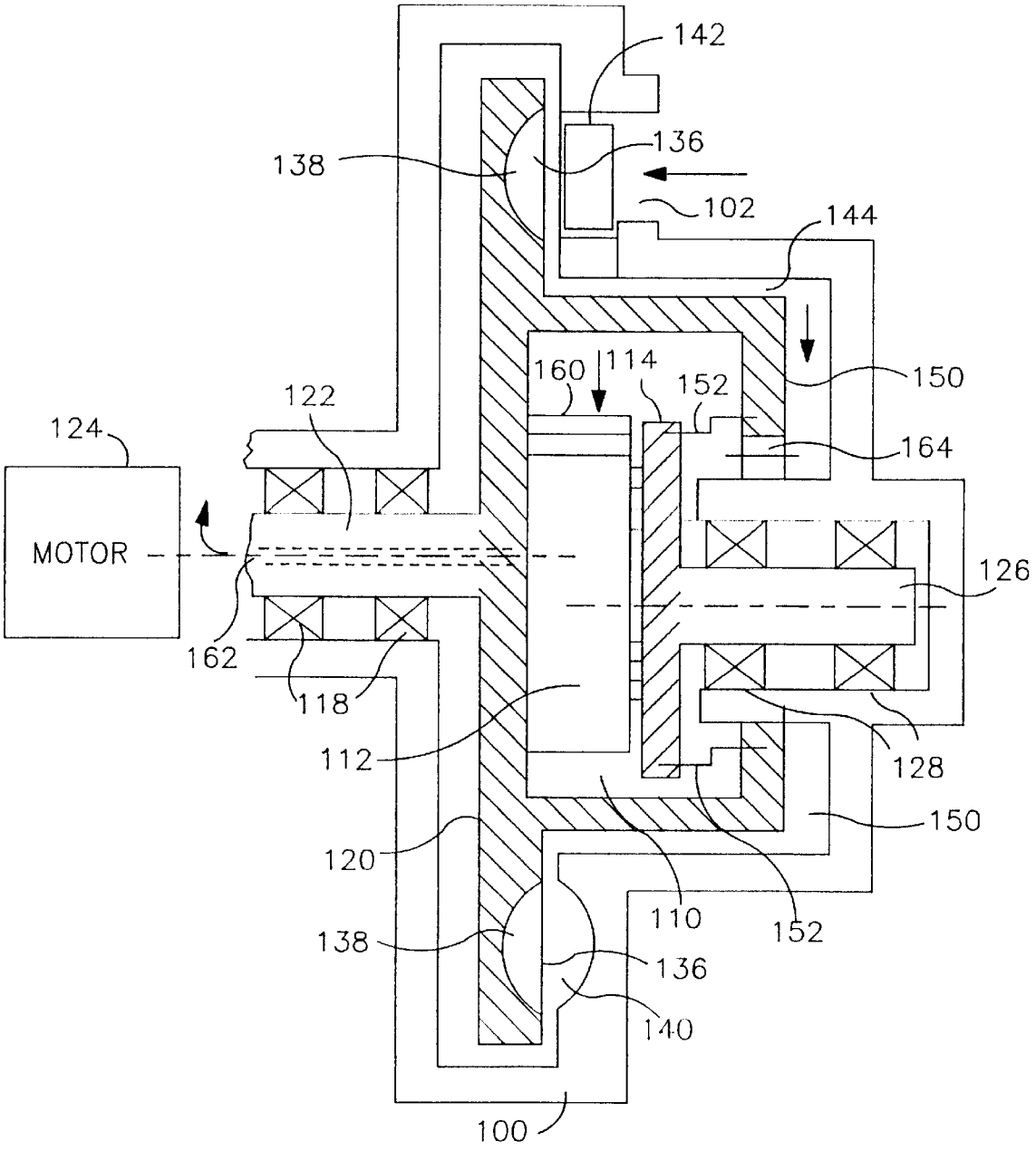
FIG. 3 is a schematic representation of vacuum pumping apparatus including a regenerative blower and a co-rotating scroll pump.

An example of vacuum pumping apparatus in accordance with a second aspect of the invention is illustrated in FIG. 3. A vacuum-tight housing 100 includes an inlet 102. A co-rotating scroll pump 110 is disposed within housing 100. The co-rotating scroll pump 110 includes a non-orbiting scroll element 112 and an orbiting scroll element 114. Scroll elements 112 and 114 include scroll blades that are meshed together to define interblade pockets as described above. The non-orbiting scroll element 112 is mounted on a circular disk 120, which is coupled by a drive shaft 122 to a motor 124. Drive shaft 122 is mounted in bearings 118. The motor 124 causes the disk 120, non-orbiting scroll blade 112 and orbiting scroll blade 114 to rotate at a prescribed speed during operation. The orbiting scroll blade 114 is coupled to a shaft 126 mounted in bearings 128. Bearings 118 and 128 are secured to housing 100 and define spaced-apart axes of rotation for shafts 122 and 126, respectively.

Disk 120 may include a cylindrical extension 150. Scroll element 114 is coupled by an orbiting mechanism, such as eccentric cranks 152, to extension 150. Typically, three cranks 152 are utilized. This configuration causes scroll element 114 to rotate at the same speed as scroll element 112 and to orbit relative to scroll element 112. It will be understood that different orbiting mechanisms may be utilized. The orbiting mechanism couples scroll element 114 to scroll element 112, so that the scroll elements rotate at the same speed and so that one scroll element orbits relative to the other. Suitable orbiting mechanisms include, but are not limited to, eccentric cranks, bellows and the Oldham coupling, which utilizes crossed sliding grooves.

Co-rotating scroll pump 110 has an inlet 160 at the outer periphery of scroll elements 112 and 114, and an outlet 162 through shaft 122. Gas may be supplied to inlet 160 through an opening 164 in extension 150 of disk 120, or through any other suitable opening in extension 150. Extension 150 can have any configuration that permits the orbiting mechanism to be coupled between scroll element 112 and scroll element 114.

An outer region of disk 120 and housing 100 comprises a regenerative blower 130. An inlet of regenerative blower 130 is coupled to housing inlet 102, and an outlet of regenerative blower 130 is coupled to inlet 160 of co-rotating scroll pump 110. Thus, regenerative blower 130 and scroll pump 110 are connected in series in the vacuum pumping apparatus of FIG. 3. The vacuum pumping apparatus of FIG. 3 thereby constitutes an embodiment of the vacuum pumping apparatus shown in FIG. 2 and described above. Typically, the regenerative blower 130 has a relatively high pumping speed, and scroll pump 110 has a relatively high compression ratio. As a result, the vacuum pumping apparatus of FIG. 3 exhibits high pumping speed and high compression ratio.

The disk 120 functions as an impeller, or rotor, and housing 100 functions as a stator of regenerative blower 130. In the example of FIG. 3, disk 120 is provided with spaced-apart radial ribs 136, and cavities 138 are defined between each pair of ribs 136. The cavities 138 may have curved contours formed by removing material of disk 120 between ribs 136. The housing 100 is provided with a circular channel 140 in opposed relationship to ribs 136 and cavities 138. The housing 100 further includes a baffle 142, or stripper, at one circumferential location. Inlet 102, connected to channel 140 on one circumferential side of baffle 142, defines an inlet of regenerative blower 130, and a conduit 144, connected to channel 140 on the other circumferential side of baffle 142, defines an outlet of regenerative blower 130.

In operation, disk 120 is rotated about shaft 122 by motor 124. Gas enters channel 140 through inlet 102 and is pumped through channel 140. The rotation of disk 120 and ribs 136 causes the gas to be pumped through cavities 138 and channel 140. The gas is then discharged through from regenerative blower 130 through conduit 144 to the inlet 160 of scroll pump 110. It will be understood that the configuration of the regenerative blower 130 may be varied within the scope of the present invention. For example, the size and shape of ribs 136, cavities 138 and channel 140 may be varied within the scope of the present invention. The structure and operation of regenerative blowers is generally known to those skilled in the art.

Figure 4:
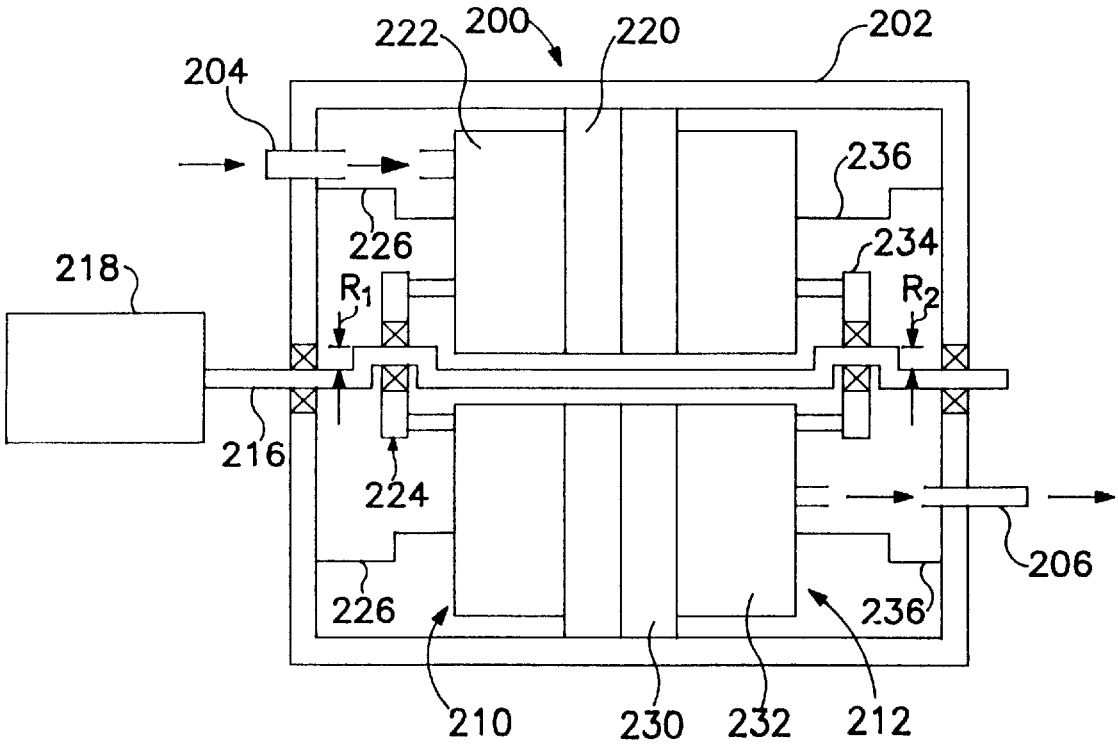
FIG. 4 is a schematic representation of vacuum pumping apparatus including first and second scroll pumps having different orbiting radii.

An example of vacuum pumping apparatus in accordance with a third aspect of the invention is illustrated in FIG. 4. Vacuum pumping apparatus 200 includes a generally vacuum-tight housing 202 having an inlet 204 and an outlet 206. A first scroll pump 210 and a second scroll pump 212 are disposed within housing 202. An inlet of first scroll pump 210 is connected to housing inlet 204 and an outlet of second scroll pump 212 is connected to housing outlet 206. A connection (not shown) between an outlet of first scroll pump 210 and an inlet of second scroll pump 212 effectively connects scroll pumps 210 and 212 in series. A drive shaft 216 connects scroll pumps 210 and 212 to a motor 218.

First scroll pump 210 includes a non-orbiting scroll blade 220, an orbiting scroll blade 222 and an eccentric drive 224 having a first orbiting radius $R_1$. Eccentric drive followers 226 coupled between orbiting scroll blade 222 and housing 200 (or another stationary element of the apparatus) permit scroll blade 222 to orbit relative to scroll blade 220, while preventing rotation of scroll blade 222. The second scroll pump 212 includes a non-orbiting scroll blade 230, an orbiting scroll blade 232 and an eccentric drive 234 having a second orbiting radius $R_2$. The non-orbiting scroll blades 220 and 230 may, for example, be formed on opposite sides of a single plate. Eccentric drive followers 236 connected between orbiting scroll blade 232 and housing 200 (or another stationary element of the apparatus) permit orbiting movement of scroll blade 232, while preventing rotation thereof.

The orbiting radius $R_1$of first scroll pump 210 is different from the orbiting radius $R_2$ of second scroll pump 212. This may be achieved, for example, by providing the eccentric drives 224 and 234 with different crank radii. Similarly, eccentric drive followers 226 and 236 have different orbiting radii which correspond to the respective crank radii. As indicated above, one of the determinants of scroll pump performance is its orbiting radius. Thus, the scroll pumps 210 and 212 may have different performance characteristics within a single vacuum pumping apparatus.

In one embodiment, the orbiting radius $R_1$ of first scroll pump 210 is larger than the orbiting radius $R_2$ of second scroll pump 212. This permits the first scroll pump 210 to have fewer turns for a given scroll blade diameter and a higher pumping speed. The second scroll pump 212 may have more turns for a given scroll blade diameter and a relatively high compression ratio. The vacuum pumping apparatus of FIG. 4 may therefore exhibit both high pumping speed and high compression ration, depending on the selection of orbiting radii $R_1$ and $R_2$.

The scroll pumps in the vacuum pumping apparatus of FIG. 4 have a conventional configuration wherein each scroll pump has a stationary scroll blade. The configuration wherein different scroll pumps in a vacuum pumping apparatus have different orbiting radii may also be applied in the case of co-rotating scroll pumps wherein both scroll blades of the scroll pump rotate and one scroll blade orbits relative to the other.

Figure 5:
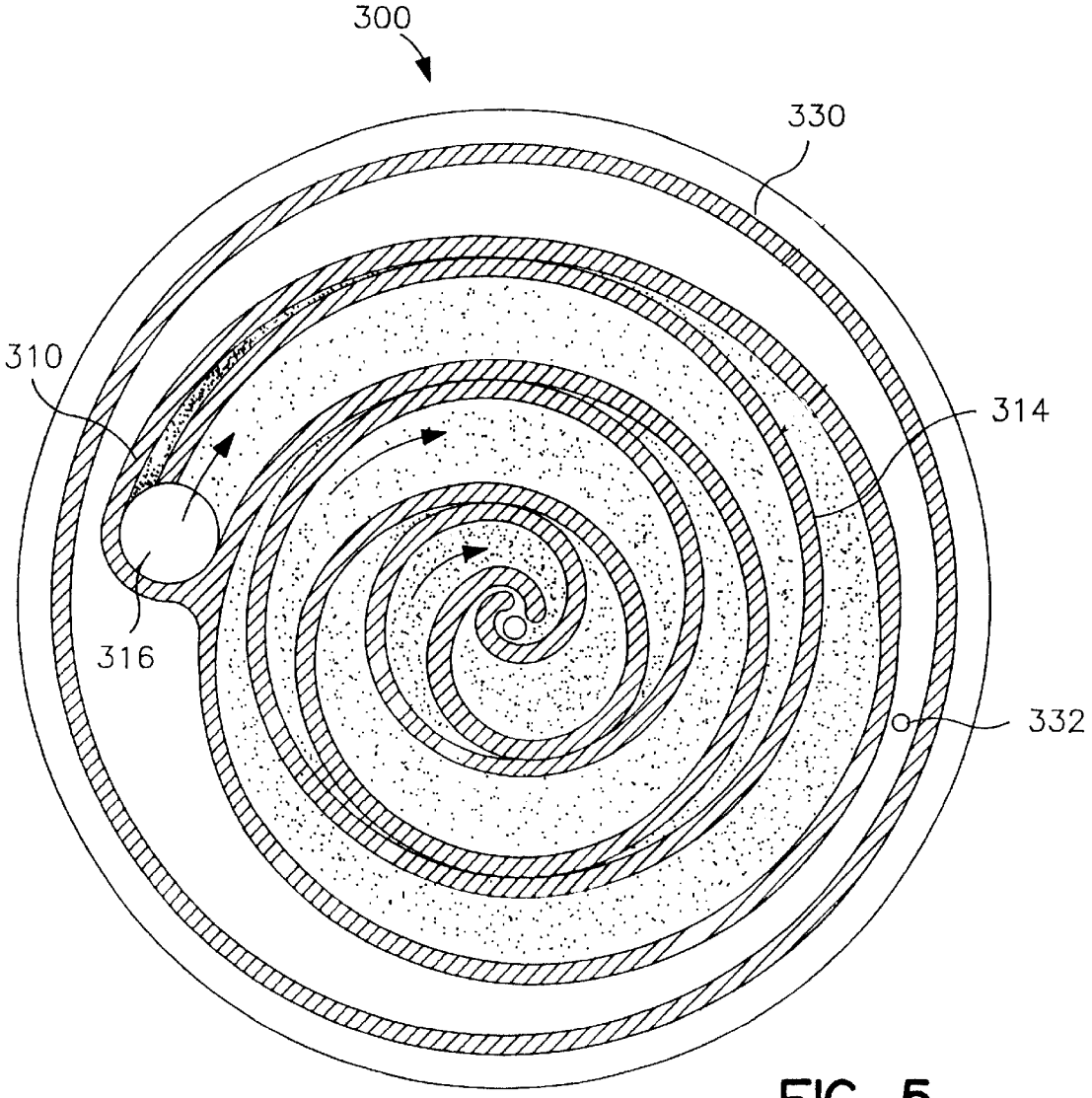
FIG. 5 is a simplified cross-sectional plan view of a scroll pump including a closed-loop outer sliding seal for limiting leakage.
Figure 6:
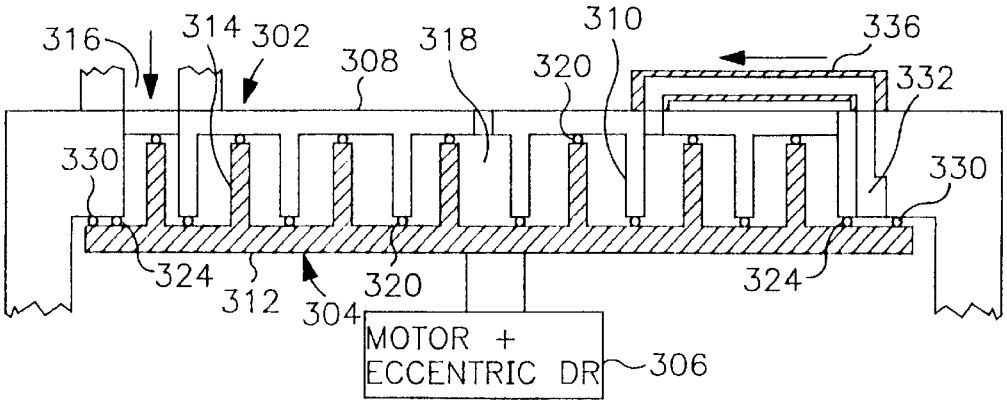
FIG. 6 is a cross-sectional elevation view of the scroll pump of FIG. 5.

An example of vacuum pumping apparatus in accordance with a fourth aspect of the invention is illustrated in FIGS. 5 and 6. A scroll vacuum pump 300 includes a non-orbiting member 302, an orbiting member 304 and an eccentric drive 306 coupled to orbiting member 304. Non-orbiting member 302 includes a plate 308 and a non-orbiting scroll blade 310 extending from plate 308. Orbiting member 304 includes a plate 312 and an orbiting scroll blade 314 extending from plate 312. The scroll pump 300 includes an inlet 316 at an outer periphery of scroll blades 310 and 314, and an outlet 318 near the center or the scroll blades. The scroll blades 310 and 314 are nested together to define one or more interblade pockets which move from inlet 316 toward outlet 318 as eccentric drive 306 produces orbiting motion of scroll blade 314 relative to scroll blade 310. Sliding seals 320 are disposed between and isolate adjacent interblade pockets. The sliding seals 320 are typically formed as strips of a resilient, durable material positioned between the edge of each scroll blade and the opposite plate. The seal material may be located in grooves in the edges of the scroll blades. The seals effectively isolate adjacent interblade pockets of the scroll pump and permit a higher compression ratio to be achieved.

One of the drawbacks of a scroll pump is that leakage from atmosphere to the inlet 316 of the scroll pump through a blade seal 324 at the outer periphery of the pump reduces the achievable vacuum, particularly where the pump has a relatively high compression ratio. Leakage into the inlet of the scroll pump may occur at any point around its periphery. In particular, with reference to FIG. 6, leakage may occur through the outermost blade seal 324 of the scroll pump from atmosphere to the inlet stage of the scroll pump. To alleviate the leakage problem, a closed-loop sliding seal 330 is positioned between the non-orbiting member 302 and the orbiting member 304 of the scroll pump outwardly of the scroll blades 310 and 314. The plate 312 of orbiting member 304 may be extended as necessary to provide a surface for sliding seal 330. The sliding seal 330 typically has a circular shape. The space between outmost blade seal 324 and closed-loop seal 330 defines an inlet volume 332 which may be connected to an intermediate pressure. During normal operation, the intermediate pressure is lower than the ambient pressure. In the example of FIGS. 5 and 6, inlet volume 332 may be connected via a conduit 336 to an intermediate stage of the scroll pump. The conduit 336 may interconnect the outer periphery of the scroll pump with an intermediate stage in the scroll pump through the non-orbiting member 302. In an alternate connection, a conduit (not shown) may be connected between inlet volume 332 and an intermediate stage of the scroll pump through the orbiting member 304. It will be understood that the inlet volume 332 may be connected to a separate vacuum pump. However, this configuration is less practical in terms of added cost than simply connecting the inlet volume 332 to an intermediate stage of the same vacuum pump. The configuration shown in FIGS. 5 and 6 reduces leakage in proportion to the ratio of the ambient pressure, such as atmosphere, to the intermediate pressure of the inlet volume 332. If the intermediate pressure is 1/10th of an atmosphere, for example, the leakage is reduced by 10 times.

In prior art scroll pumps utilizing a single scroll blade set, the motor and the driving mechanism are positioned on the orbiting scroll blade side of the scroll pump. This configuration is mechanically simple, but is subject to leakage through the seals adjacent to the inlet as described above. Because the motor and the drive mechanism are located adjacent to the inlet, oil and particulate contamination may enter the scroll pump.

Figure 7:
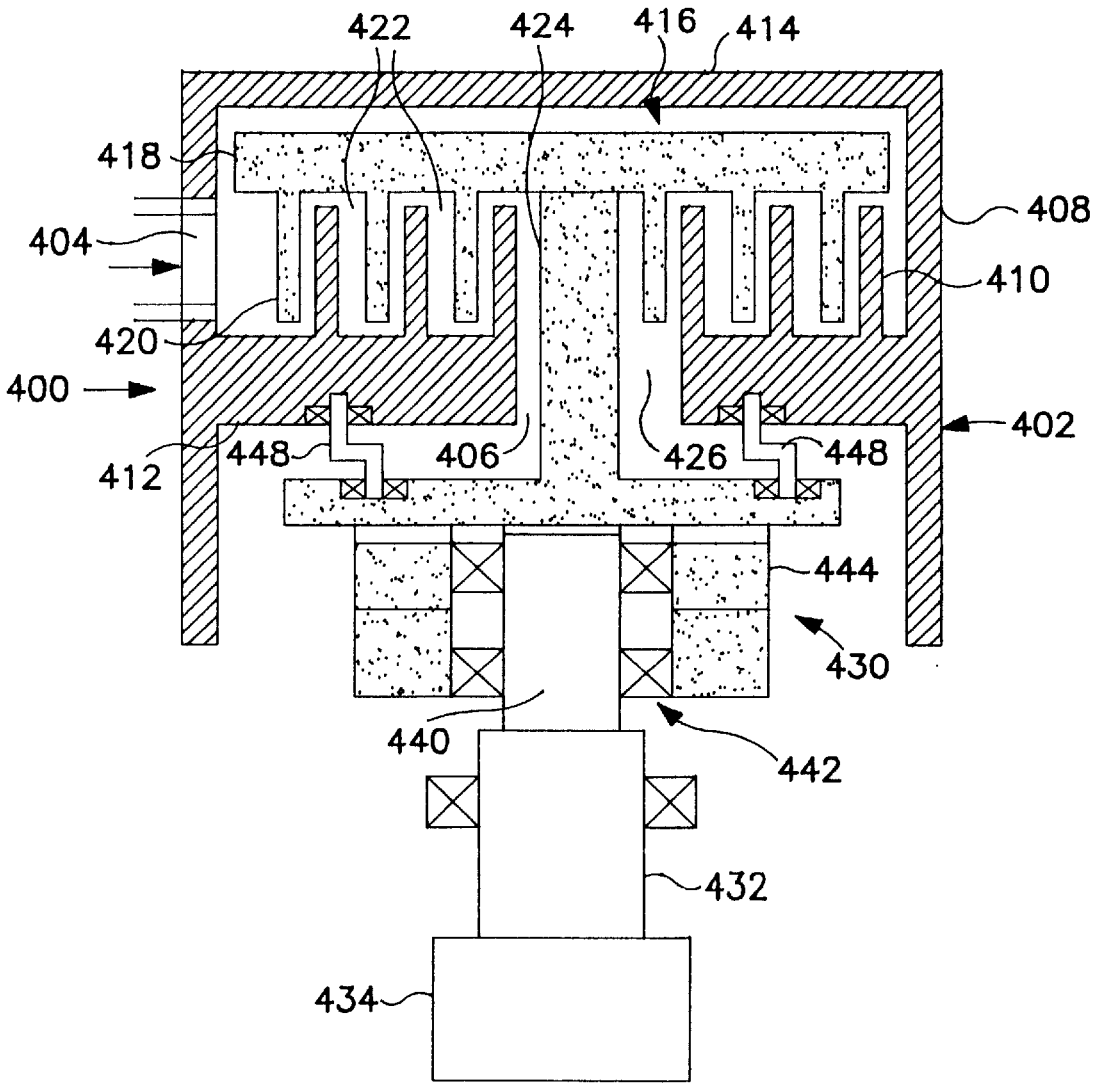
FIG. 7 is a simplified cross-sectional view of a scroll pump in accordance with another embodiment of the invention where the motor is placed on the side of the stationary scroll blade.

A scroll pump configuration which overcomes these drawbacks is shown in FIG. 7. A scroll pump 400 includes a single scroll blade set within a housing 402 having an inlet 404 and an outlet 406. The housing 402 may include a cylindrical portion 408 closed at one end by a plate 412 and closed at the other end by a plate 414. A non-orbiting scroll blade 410 extends upwardly from plate 412. An orbiting member 416, including a plate 418 and an orbiting scroll blade 420 extending downwardly from plate 418, is positioned in housing 402. Scroll blades 410 and 420 are nested together to define interblade pockets 422. Orbiting member 416 is connected by a shaft 424 through an opening 426 in plate 412 to an eccentric drive 430. The opening 426 is adjacent to or coincident with outlet 406 of the scroll pump. The eccentric drive 430 is connected by a drive shaft 432 to a motor 434. The eccentric drive 430 may, for example, include a cam 440 coupled by bearings 442 to a drive housing 444. Drive housing 444 is rigidly connected to shaft 424. Eccentric drive followers 448 are coupled between plate 412 of housing 402 and drive housing 444. When the motor 434 is energized, the eccentric drive 430 produces orbiting movement of scroll blade 420 relative to scroll blade 410. Interblade pockets 422 between scroll blades 410 and 420 are caused by the orbiting of scroll blade 420 to move toward outlet 406 and thereby pump gas from inlet 404. It will be understood that a variety of different eccentric drives may be utilized within the scope of the present invention.

In the scroll pump configuration of FIG. 7, motor 434 and drive mechanism 430 are positioned adjacent to outlet 406 of the scroll pump, thereby reducing the risk that contaminants generated by motor 434 and eccentric drive 430 will be drawn into the pump through inlet 404. Furthermore, housing 402 is configured to substantially enclose scroll blades 410 and 420, so that leakage at the inlet to the scroll pump is limited. In the configuration of FIG. 7, scroll blades 410 and 420 are substantially enclosed by cylindrical housing portion 408 and plates 412 and 414.

Having thus described at least one illustrative embodiment of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed is:

1. Vacuum pumping apparatus comprising:

a housing;

a scroll pump disposed in said housing, said scroll pump having an inlet and an outlet, said scroll pump comprising first and second nested scroll blades and an orbiting mechanism coupled between said first and second scroll blades for producing orbiting movement of said first scroll blade relative to said second scroll blade;

a non-scroll type auxiliary pump disposed in said housing, said auxiliary pump having an inlet and an outlet, said auxiliary pump comprising a disk rigidly coupled to said second scroll blade for rotation with said second scroll blade, said disk having a plurality of cavities at or near its outer periphery, said housing having a channel in opposed housing having a channel in opposed relationship to said cavities, said disk and said channel defining said auxiliary pump;

conduit means for coupling fluid from the outlet of said auxiliary pump to the inlet of said scroll pump, whereby said auxiliary pump and said scroll pump are connected in series, and said fluid is pumped by said auxiliary pump and said scroll pump; and a motor operationally connected to said auxiliary pump and operationally connected to said scroll pump for rotating said first and second scroll blades, wherein said auxiliary pump comprises a regenerative blower.

2. Vacuum pumping apparatus comprising:

a housing;

a scroll pump disposed in said housing, said scroll pump having an inlet and an outlet, said scroll pump comprising first and second nested scroll blades and an orbiting mechanism coupled between said first and second scroll blades for producing orbiting movement of said first scroll blade relative to said second scroll blade;

a motor operationally connected to said scroll pump for rotating said first and second scroll blades;

a disk rigidly coupled to said second scroll blade for rotation with said second scroll blade, said disk having a plurality of cavities at or near its outer periphery, said housing having a channel in opposed relationship to said cavities, said disk and said housing defining an auxiliary pump having an inlet and an outlet; and conduit means for coupling fluid from the outlet of said auxiliary pump to the inlet of said scroll pump, whereby said auxiliary pump and said scroll pump are connected in series and said fluid is pumped by said auxiliary pump and said scroll pump, wherein said auxiliary pump comprises regenerative blower.

3. Vacuum pumping apparatus as defined in claim 2, wherein said second scroll blade is attached to the center of said disk.

4. Vacuum pumping apparatus as defined in claim 2, wherein said orbiting mechanism comprises a plurality of eccentric cranks.

* * * * *